United States Patent [19]

Fuchs, Jr.

[11] 4,425,775

[45] Jan. 17, 1984

[54] METHODS FOR EXTRUSION

[75] Inventor: Francis J. Fuchs, Jr., Princeton Junction, N.J.

[73] Assignee: Western Electric Co., New York, N.Y.

[21] Appl. No.: 318,293

[22] Filed: Nov. 4, 1981

Related U.S. Application Data

[62] Division of Ser. No. 926,164, Jul. 19, 1978, Pat. No. 4,319,476.

[51] Int. Cl.[3] ..... B21C 23/32; B21C 27/00; B21C 33/00

[52] U.S. Cl. ..... 72/270; 72/272; 72/273.5; 72/253.1

[58] Field of Search ..... 72/253.1, 263, 273.5, 72/270, 272, 60

[56] References Cited

U.S. PATENT DOCUMENTS

| | | | |
|---|---|---|---|
| Re. 28,795 | 5/1976 | Fuchs | 72/60 |
| 571,306 | 11/1896 | Geyer . | |
| 1,904,947 | 4/1933 | Leech . | |
| 3,440,853 | 4/1969 | Tombaugh | 72/253 |
| 3,520,164 | 7/1970 | Pennell et al. | 72/270 |
| 3,538,730 | 11/1970 | Alexander et al. | 72/60 |
| 3,548,625 | 12/1970 | Fuch | 72/272 |
| 3,563,080 | 2/1971 | Alexander et al. | 72/272 |
| 3,696,652 | 10/1972 | Fuch | 72/60 |
| 3,740,985 | 6/1973 | Fuch | 72/60 |
| 3,766,768 | 10/1973 | Fuchs et al. | 72/256 |
| 3,852,986 | 12/1974 | Fuchs | 72/60 |
| 3,985,011 | 10/1976 | Fuchs | 72/60 |
| 4,005,596 | 2/1977 | Uralsky | 72/60 |
| 4k027,514 | 6/1977 | Moreau | 72/60 |
| 4,112,723 | 9/1978 | Asari | 72/60 |
| 4,208,897 | 6/1980 | Akeret | 72/272 |

FOREIGN PATENT DOCUMENTS

| | | | |
|---|---|---|---|
| 1594423 | 7/1970 | France | 72/253.1 |
| 40-26411 | 3/1965 | Japan | 72/270 |
| 43-5216 | 4/1968 | Japan | 72/270 |
| 47-14008 | 2/1972 | Japan | 72/60 |
| 49-5827 | 2/1974 | Japan | 72/270 |
| 522885 | 8/1976 | U.S.S.R. | 72/60 |

OTHER PUBLICATIONS

"An Experimental Determination of the Axial Pressure Profile in a Hydrostatic Extruder" by D. E. Drake 11/15/73 an ASME Publication.

*Primary Examiner*—Lowell A. Larson

*Attorney, Agent, or Firm*—A. S. Rosen; M. Pfeffer; D. J. Kirk

[57] ABSTRACT

Two elongated gripping members (12,12) cooperate to form a closed pressure chamber about a waxed billet (61). The gripping members are reciprocated relative to an extrusion station (13), such reciprocation first moving the pressure chamber toward and past the extrusion station so as to extrude the billet through a die (66) at the extrusion station, and then returning the gripping members, in separated condition, to their initial positions to permit the immediate loading of another billet between the gripping members. Also disclosed are various additional systems, e.g., for feeding billets between the gripping members from a magazine; for coating the billets with wax; for automatically changing dies at the extrusion station; for providing soft, dummy billets to facilitate the complete extrusion of each successive billet, and to serve as soft, starting noses as each successive extrusion operation begins; for applying, along exterior surfaces of the gripping members, a pressure gradient increasing in the direction of the extrusion station, to match increasing pressure levels within each waxed billet during extrusion; and for so stressing and/or prestressing certain structural elements as to oppose high, extrusion-caused stresses.

4 Claims, 18 Drawing Figures

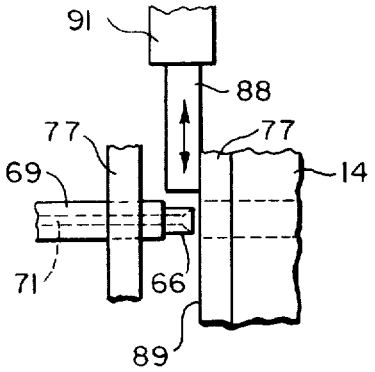
FIG. 10
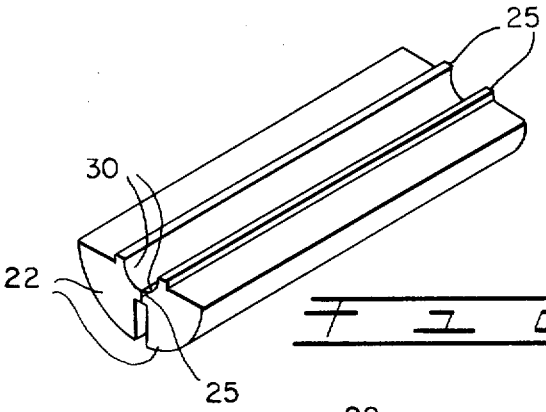
FIG. 11
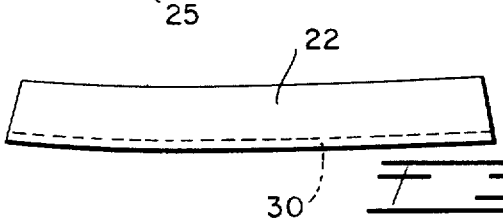
FIG. 12
FIG. 13
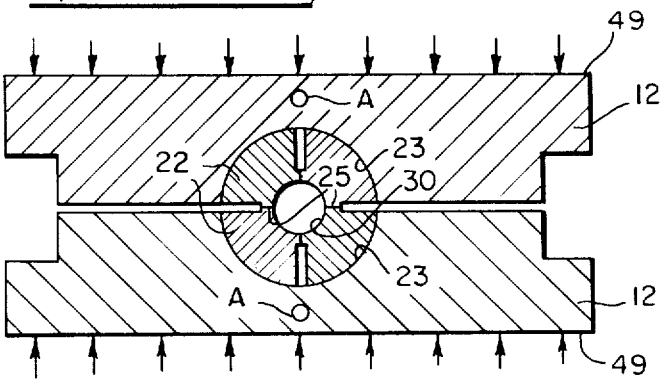

METHODS FOR EXTRUSION

This is a division, of application Ser. No. 926,164 filed July 19, 1978, now U.S. Pat. No. 4,319,476, issued Mar. 16, 1982.

BACKGROUND OF THE INVENTION

1. Field of the Invention

The invention relates to methods for deforming an elongated workpiece so as to form an elongated product and, more particularly, to methods and apparatus for extruding one or more elongated workpieces through apertures in one or more dies so as to form one or more elongated products.

2. Description of the Prior Art

In the art of forming elongated products of definite length by extruding elongated workpieces of definite length through suitable dies, it is known to employ hydrostatic extrusion techniques, i.e., to apply sufficient hydrostatic pressure to a billet within a pressure vessel to force the billet to pass through an aperture in a die located at an end of the pressure vessel. Typical pressure vessels include solid bore chambers, i.e., closed, cylindrical pressure chambers, with or without liners. It is difficult, however, to load billets into solid bore chambers, especially billets with coatings, e.g., waxes, which are preferred hydrostatic extrusion media for various reasons, such as are set forth in U.S. Pat. Nos. 3,740,985 and 3,985,011, both issued to F. J. Fuchs, Jr., the former of which has been reissued as U.S. Pat. No. Re. 28,795. Each such billet must, together with its wax coating, occupy the entire volume of the solid bore chamber in the vicinity of the die. The only practical loading technique has involved heating the entire solid bore chamber above the melting point of the wax, and then introducing both molten wax and the billet into the heated chamber. Clearly, this is a slow and laborsome billet loading technique, which is not suited to efficient operation of the extrusion apparatus. Indeed, even if it is desired that hot billets be extruded, such billet loading technique may be considered unduely cumbersome and costly.

Solid bore chambers also are subject to fatigue fractures, e.g., in bore liners, caused by severe hoop stress conditions. The use of hydrostatic pressure jackets has alleviated this problem to some degree. It is still common, however, to experience an unbalanced pressure relationship between the external jacket pressure and the internal bore pressure, with the imbalance increasing axially toward the die, during each operation of a hydrostatic billet extruder with a solid bore chamber.

Typical hydraulic billet extrusion techniques also require pressure containers of high strength steel. Difficulties involved in providing such containers of sufficient size generally render it impractical to build very large billet extruders.

It is known, also, to extrude an elongated workpiece of indefinite length continuously through a die, so as to form an elongated product of indefinite length, by driving a number of trains of gripping members continuously, each about an endless path in a single direction of movement, with adjacent portions of the various endless paths coming together, operatively engaging the surface of the workpiece, and advancing the workpiece continuously toward and through the die. The workpiece may initially be coated with a suitable hydrostatic medium, e.g., a wax, with the apparatus including mechanisms for providing a gradient in pressure, increasing in the direction of the die, for externally supporting the gripping members against increasing pressure in the workpiece and the coating thereon as the coated workpiece is forced continuously into the die by the continuously advancing gripping members. Two examples of such continuous extrusion techniques are provided by the previously mentioned U.S. Pat. Nos. 3,740,985 and 3,985,011, the former of which has been reissued as U.S. Pat. No. Re 28,795.

The techniques and the apparatus disclosed in such previously mentioned patents, while also capable of extruding successions of billets of definite length to form successions of elongated products of definite length where the billets are of small or moderate cross-section, are specifically designed for the continuous extrusion of elongated workpieces of indefinite length to form elongated products of indefinite length. To some extent, various factors, such as maximum cross-sectional area of each elongated workpiece and rapid replaceability of extrusion dies with new dies of similar or differing aperture configurations, may be sacrified in such apparatus in order to permit continuous, high-speed extrusion to occur. Accordingly, it would clearly be advantageous to have at one's disposal methods and apparatus which are particularly suited to overcoming the previously discussed problems in the hydrostatic extrusion of billets of definite length, and which will preferably also permit the rapid and efficient extrusion of a succession of either heated or unheated billets of definite length, which billets may have relatively large cross-sections, with successive extrusions taking place either through the same die to form a succession of like elongated products, or through a plurality of rapidly interchanged dies to form either a succession of like elongated products or a succession of varying elongated products.

SUMMARY OF THE INVENTION

The invention contemplates operatively engaging a plurality of gripping members with an elongated workpiece and reciprocating the plurality of gripping members relative to an extrusion station in such manner as to extrude at least a portion of the elongated workpiece through an aperture in a die at the extrusion station, thereby forming an elongated product. More particularly, the elongated workpiece, which may be a billet of definite length, is initially operatively engaged in a retracted position of the plurality of gripping members, with at least a portion of the plurality of gripping members effectively gripping, e.g., through a coating of a hydrostatic medium covering the elongated workpiece, at least a substantial length of the elongated workpiece while causing a closed chamber to be formed thereabout. Reciprocation of the plurality of gripping members first moves the plurality of gripping members away from the retracted position thereof and in the direction of the extrusion station to an extent sufficient to advance at least a portion of the closed chamber about and past the die aperture, thereby forcing at least a portion of the elongated workpiece through the die aperture and at least partly forming the elongated product. The plurality of gripping members is then moved away from the extrusion station and again into the retracted position of the plurality of gripping members, withdrawing the chamber from the extrusion station. The plurality of gripping members may be separated, e.g., immediately subsequent to the movement in the direction of the extrusion station, in such manner as to open the closed chamber, so that another elongated workpiece, or another longitudinal portion of the same elongated workpiece, may immediately be operatively engaged by the plurality of gripping members and advanced in the direction of the extrusion station upon a succeeding movement of the plurality of gripping members. In addition, a succession of dies may be introduced between the plurality of gripping members, and may be advanced into the extrusion station by the reciprocating movements of the plurality of gripping members.

BRIEF DESCRIPTION OF THE DRAWING

FIGS. 2A and 2B are side elevational views of two adjacent, longitudinal portions of the first embodiment of extrusion apparatus, with the longitudinal portion of the apparatus depicted in FIG. 2A corresponding to the longitudinal portion of the apparatus depicted in FIG. 1B, and with the longitudinal portion of the apparatus depicted in FIG. 2B extending to the right (as viewed in FIGS. 2A and 2B) from, and overlapping, the longitudinal portion of the apparatus depicted in FIG. 2A, FIG. 2B including a cut-out segment, shown in cross-section, illustrating more clearly certain parts of a mechanism for reciprocating a pair of gripping members which are included in the apparatus;

FIG. 10 is a schematic illustration of a mechanism which may be utilized to eject each successive die, which is to be replaced, from a die-supporting, die stem;

FIG. 11 is an isometric view of a pair of adjacent sectors which are inserted into a portion of a semicircular channel in each gripping member;

FIG. 12 is a side elevational view of one of the sectors in FIG. 11 prior to insertion into the semicircular channel;

FIGS. 13 and 14 are vertical cross-sectional views showing portions of the structure depicted in FIG. 4, with some parts removed for the purpose of a clearer discussion of certain patterns of stresses established within the structure, FIG. 14 illustrating a portion of the structure prior to the tightening of two depicted bolts;

DETAILED DESCRIPTION

Figure 1A:
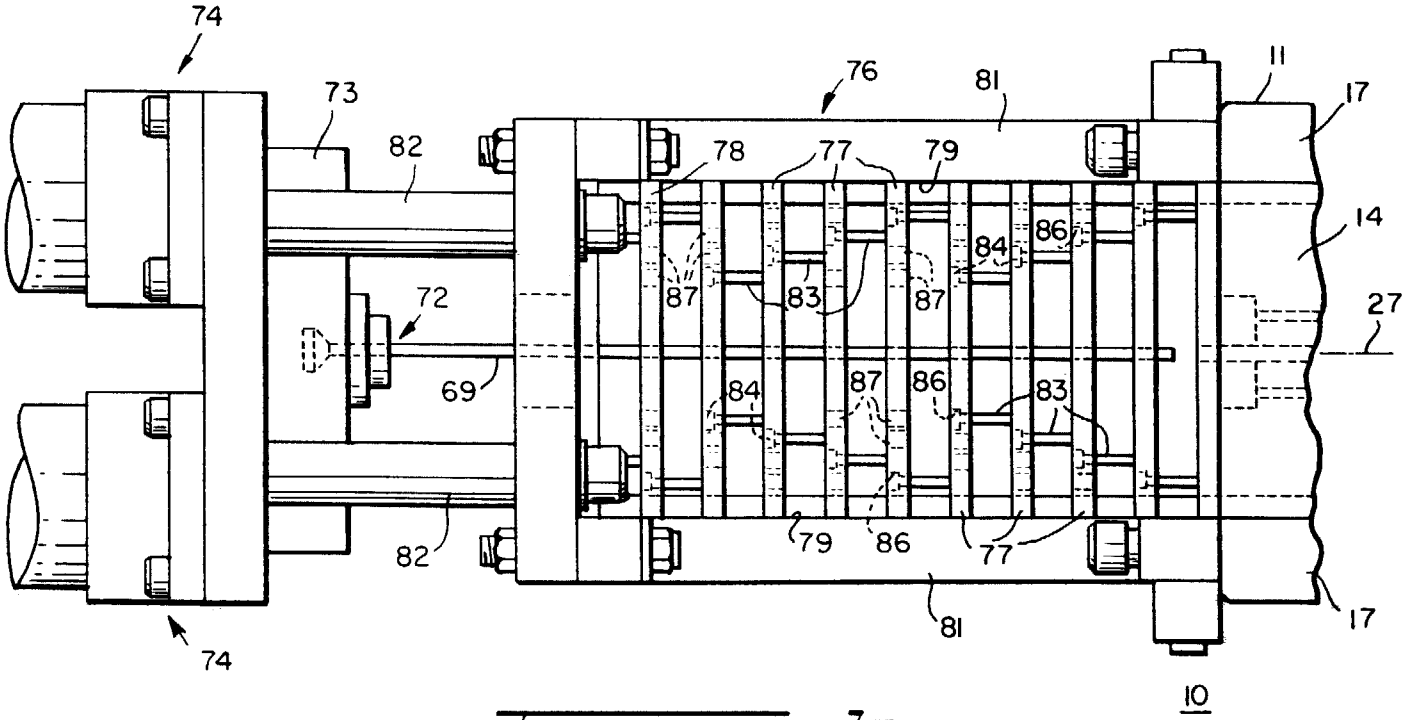
FIGS. 1A and 1B of the drawing are plan views of two adjacent, longitudinal portions of a first embodiment of extrusion apparatus constructed in accordance with the principles of the invention, with the longitudinal portion of the apparatus depicted in FIG. 1B extending to the right (as viewed in FIGS. 1A and 1B) from, and slightly overlapping, the longitudinal portion of the apparatus depicted in FIG. 1A.
Figure 1B:
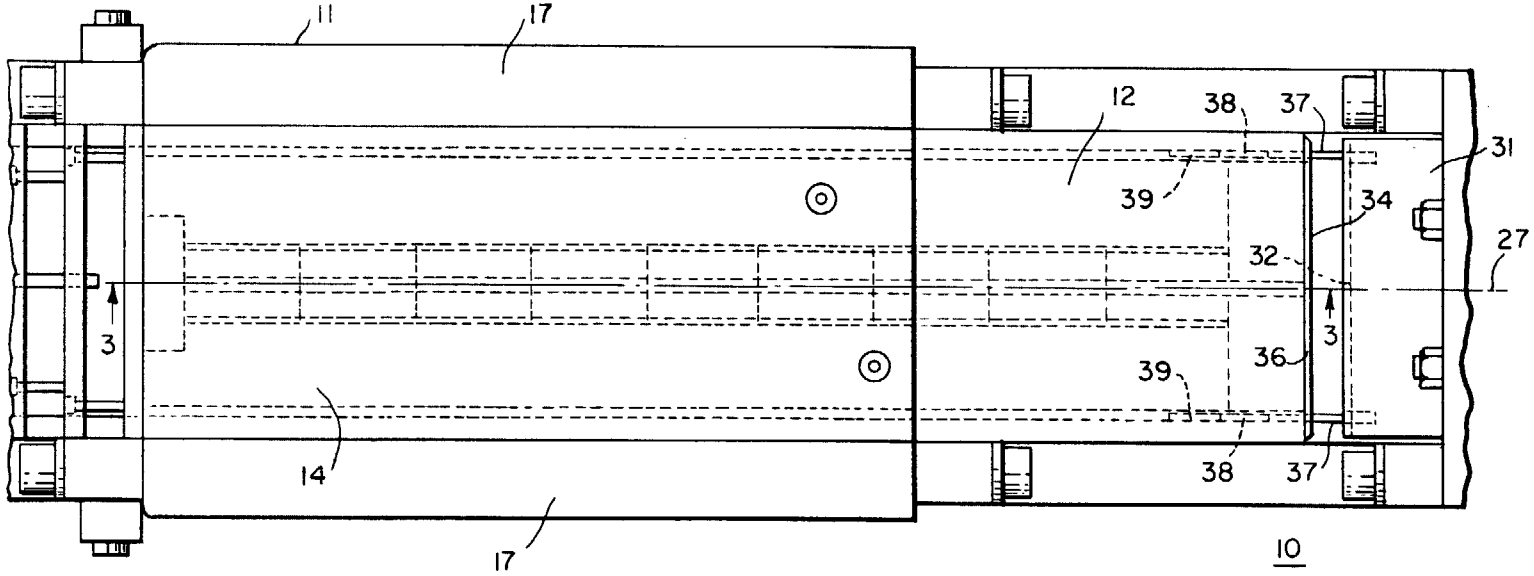
Figure 2A:
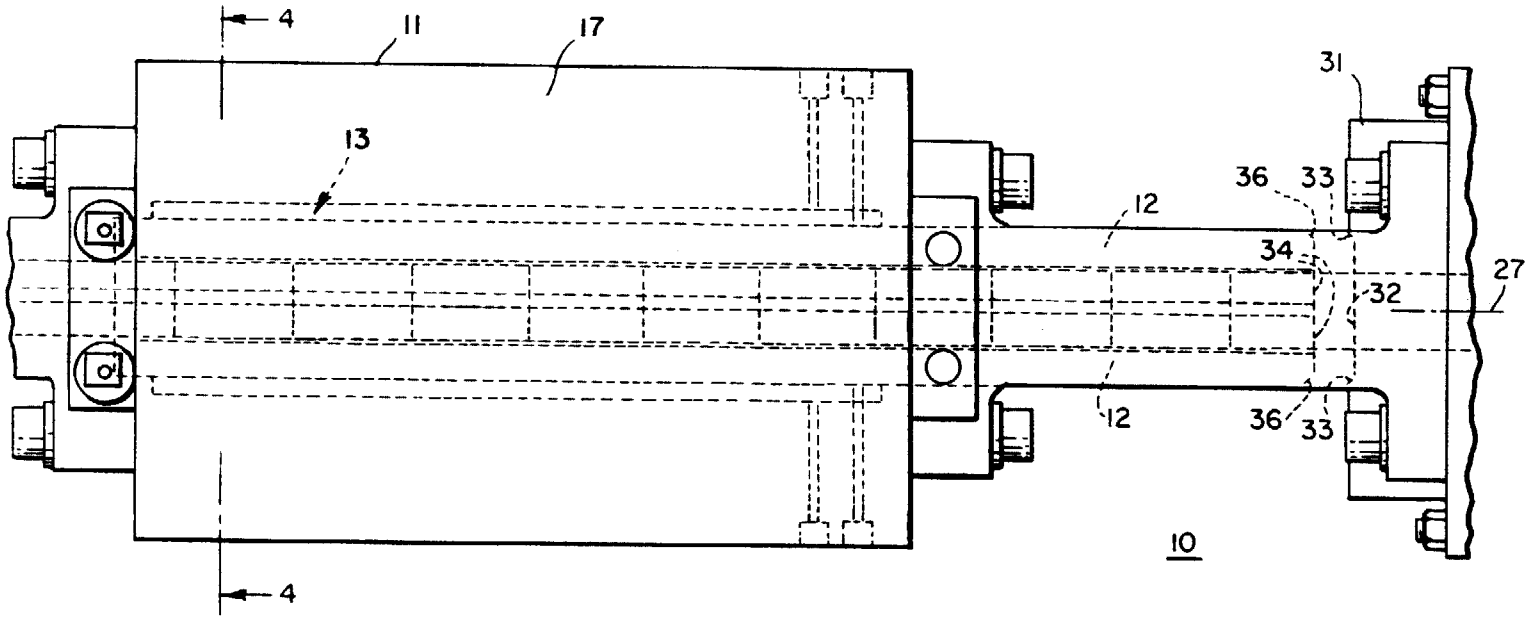

Referring initially to FIGS. 1A, 1B, 2A and 2B of the drawing, an apparatus 10 is illustrated. The apparatus 10 constitutes a first embodiment of apparatus in accordance with the invention for extruding an elongated workpiece through an aperture in a die so as to form an elongated product. The apparatus 10 may be employed in a succession of operations, either to extrude a succession of elongated workpieces of definite length, i.e., billets, thereby forming a succession of elongated products of definite length, or to extrude successive longitudinal portions of an elongated workpiece of indefinite length, thereby forming an elongated product of indefinite length. The elongated workpiece or workpieces may be composed of any suitable material, typically a metallic material such as copper or aluminum, may be either heated or unheated, and may be extruded into any suitable shape, e.g., right circular cylindrical, parallelepipedal, multiple wire tape or tubular, as determined by the configuration of one or more dies which are employed with the apparatus 10.

Figure 3:
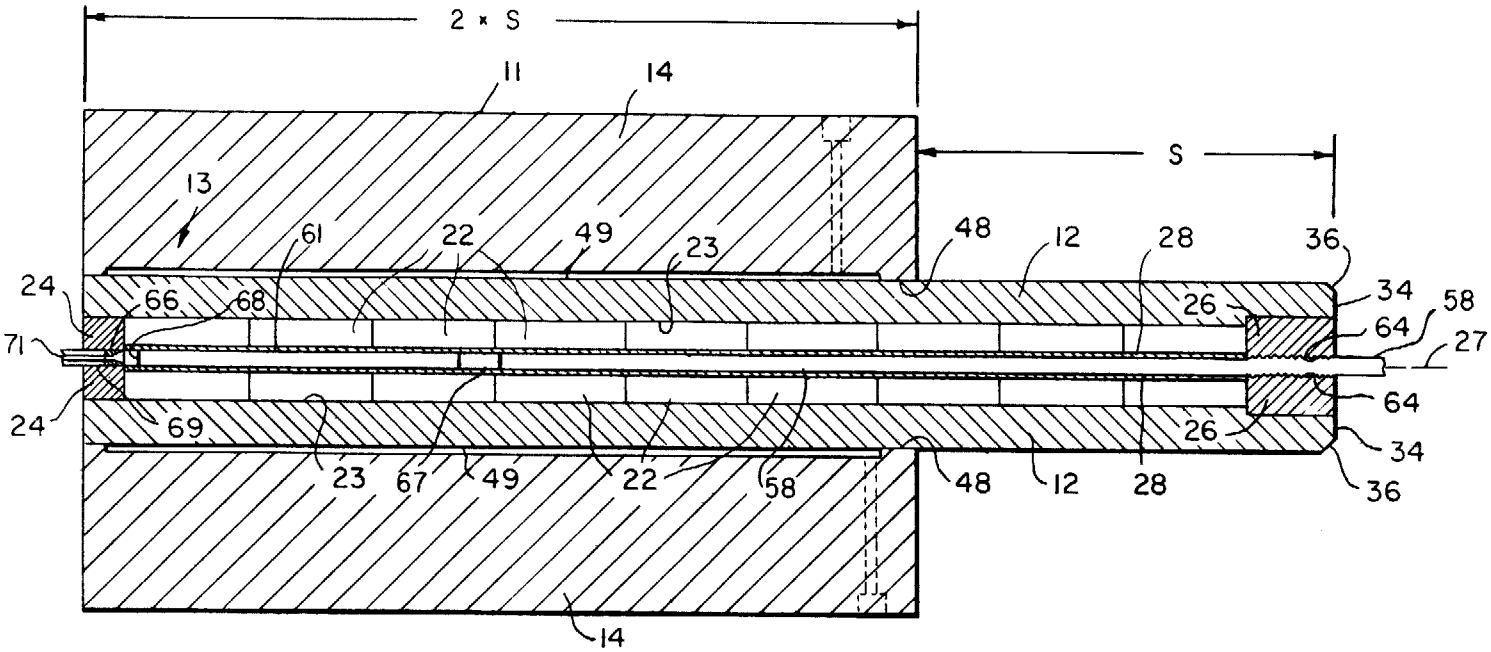
FIG. 3 is a vertical cross-sectional view of a major part of the longitudinal portion of the first embodiment of extrusion apparatus depicted in FIGS. 1B and 2A, taken along a central plane represented by line 3—3 in FIG. 1B, showing the gripping members of the apparatus, as well as a frame structure which surrounds portions of the gripping members.
Figure 4:
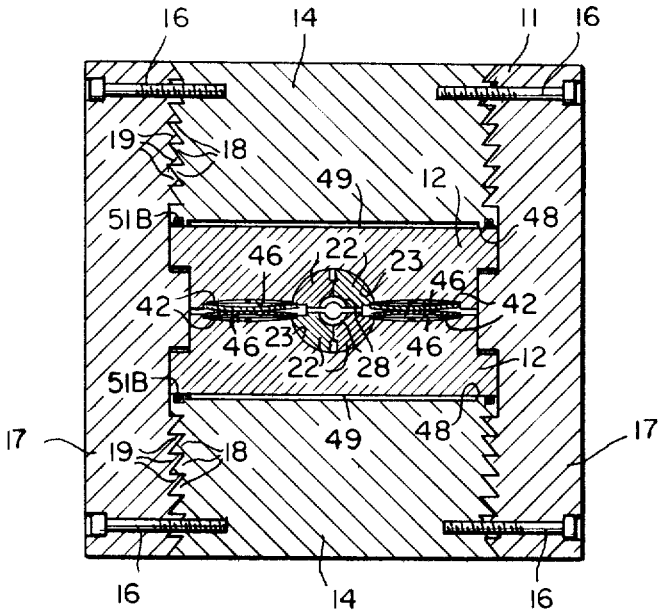
FIG. 4 is a vertical cross-sectional view through the first embodiment of extrusion apparatus in the vicinity of an extrusion station, looking in the direction of line 4—4 in FIG. 2A, further illustrating the gripping members and the surrounding frame structure.
Figure 5:
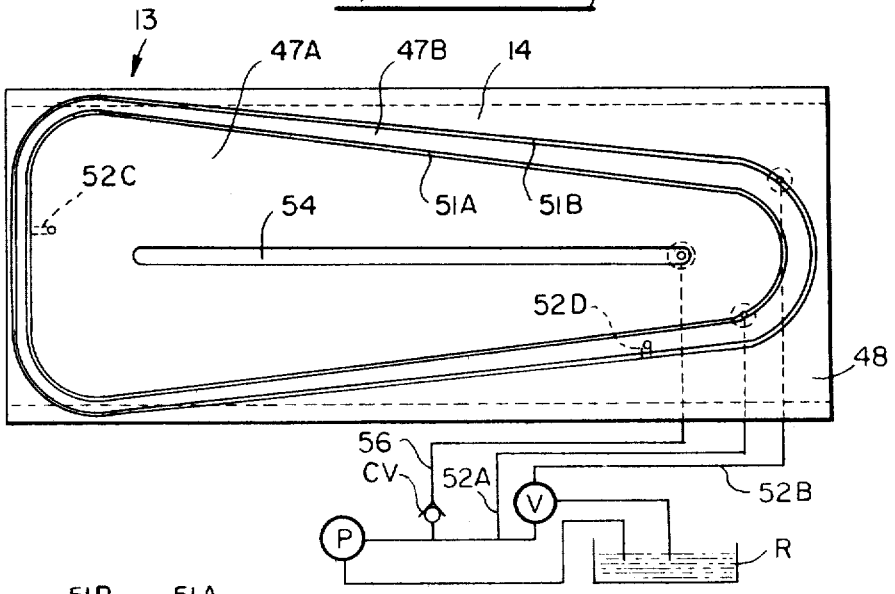
Figure 6:
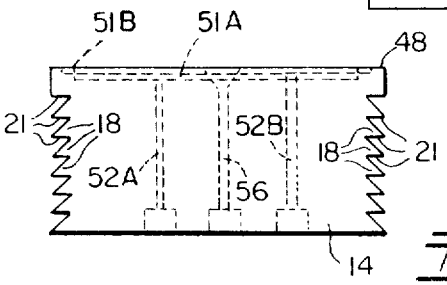
FIG. 6 is a vertical end view of the pressure block of FIG. 5, illustrating additional features of the pressure block.

The apparatus 10 includes a frame structure 11 which surrounds a plurality of elongated, gripping members 12,12, for example, two gripping members 12,12 (see FIGS. 3 and 4). The gripping members 12,12 are adapted for longitudinal reciprocating movement, first toward and past an extrusion station 13 (FIG. 3), and then back away from the extrusion station 13, while partly housed within pressure supporting facilities provided by a number of non-reciprocating, pressure blocks 14,14, for example, two pressure blocks 14,14. The pressure blocks 14,14 are retained in the frame structure 11, vertically outwardly of the gripping members 12,12, by virtue both of a number of bolts 16,16 (FIG. 4) which extend horizontally into the pressure blocks 14,14 from a pair of side wall members 17,17, and of a number of interlocking serrations 18,18 and 19,19 on each pressure block 14 and each side wall member 17, respectively. As may be seen in FIG. 6 of the drawing, each serration 18 on a pressure block 14 (only the lower pressure block 14 being shown in FIG. 6) has a horizontally extending, vertically outwardly facing surface 21 which mates with an associated, horizontally extending, vertically inwardly facing surface of a serration 19 on one or the other of the side wall members 17,17 (FIG. 4) in order to support vertically outwardly directed forces on the pressure blocks 14,14, as will be further described below.

Each gripping member 12 includes a number of sets of sectors 22,22, for example, two sets of ninety degree, arcuate sectors 22,22 (FIGS. 4 and 11). The sectors 22,22 constitute inserts, press-fitted into a semicircular channel 23 extending longitudinally (FIG. 3) along each gripping member 12 between a pair of end members 24 and 26, which end members 24 and 26 are attached by any suitable means, such as bolts (not shown), at respective forward and rearward ends of the gripping member 12. Each individual set of sectors 22,22 includes a plurality of sectors 22,22, for example, the nine sectors 22,22 shown for each set in FIG. 3 of the drawing, with the sectors 22,22 of each set arrayed along a longitudinally extending line running parallel to a longitudinal axis 27 of the apparatus 10. Adjacent sectors 22,22 in adjacent sets of sectors 22,22 engage one another along raised land areas 25,25 (FIG. 11), which border contacting, arcuate, radially-innermost surfaces 30,30 of the adjacent sectors 22,22.

Located radially inwardly (FIG. 4) of the two sets of ninety degree sectors 22,22 of each gripping member 12, i.e., toward the longitudinal axis 27 from the sectors 22,22, is an elongated, one hundred eighty degree, chamber-forming element 28, which is press-fitted into the two sets of sectors 22,22 between the end members 24 and 26 (FIG. 3) along the arcuate, radially-innermost surfaces 30,30 (FIG. 11) of the sectors 22,22. The two, one hundred eighty degree, chamber-forming elements 28,28, which are associated with the two gripping members 12,12, are so shaped (FIG. 4) as to cooperate with one another to form a sleeve-like structure extending the length of the sets of sectors 22,22. This combined, sleeve-like structure will serve to operatively engage an elongated workpiece, while forming a closed, axially-extending, pressure chamber about the elongated workpiece.

As has already been mentioned, the two gripping members 12,12, each of which includes two sets of sectors 22,22, one end member 24 (FIG.3), one end member 26 and one chamber-forming element 28, are adapted for simultaneous reciprocation along the longitudinal axis 27 of the apparatus 10, while partly housed within the non-reciprocating pressure blocks 14,14. Such reciprocation, as will be discussed more fully hereinafter, will be between a rearward or retracted position of the gripping members 12,12 and a forward or extended position of the gripping members 12,12. Upon each movement of the gripping members 12,12 toward their extended position, i.e., leftwardly in FIG. 3 of the drawing, the elongated workpiece, while operatively engaged by the two cooperating, chamber-forming elements 28,28, will be advanced toward and past the extrusion station 13, such that the elongated workpiece will be extruded through a die at the extrusion station 13 to form an elongated product.

A drive mechanism for reciprocating the gripping members 12,12 relative to the extrusion station 13 will next be described. The drive mechanism includes a pair of conventional, hydraulic piston and cylinder assemblies 29,29 (FIG. 2B), which are located at opposite sides of the longitudinal axis 27 of the apparatus 10. The piston and cylinder assemblies 29,29 are operable under the control of a conventional hydraulic control system (not shown) to reciprocate a drive block 31 (FIGS. 1B, 2A and 2B) along the direction of the longitudinal axis 27.

The drive block 31 includes a recessed, forward-facing (i.e., leftward-facing in FIGS. 1B, 2A and 2B), drive surface 32, which drive surface 32 is bordered at its top and bottom by a pair of forwardly and outwardly tapering, camming surfaces 33,33. The drive surface 32 on the drive block 31 is so located as to engage a rearward-facing, end surface 34 (see also FIGS. 3 and 8) of each of the gripping members 12,12, and to drive the engaged gripping members 12,12 forwardly upon forward movement of the drive block 31. The camming surfaces 33,33 are so located as to engage a pair of correspondingly shaped, follower surfaces 36,36 along top and bottom portions of the rearward-facing, end surfaces 34,34 of the gripping members 12,12, just prior to the engagement of the drive surface 32 with the end surfaces 34,34. Thus, the camming surfaces 33,33 are adapted to cam the gripping members 12,12 vertically toward one another at their rearward ends, thereby providing an auxiliary agency for moving the gripping members 12,12 vertically together. A fluid-operated system, which serves as a primary agency for moving the gripping members 12,12 vertically together, will be described below.

A pair of generally "H"-shaped plates 37,37 (FIGS. 1B and 2B) extends forwardly from the drive block 31. A forward leg 38 of each plate 37 is received within a recess 39 formed by cooperating indented regions 41,41 (FIG. 2B) along facing, interior portions of the two gripping members 12,12. Two such recesses 39,39 are formed in the pair of gripping members 12,12 (FIG. 1B), with one recess 39 located near a vertically outward edge of each gripping member 12, and with each such recess 39 receiving the forward leg 38 of a different one of the two plates 37,37. The length of each recess 39, along the direction of the longitudinal axis 27, is greater than the length in the same direction of the forward leg 38 of the associated plate 37 (FIG. 2B), thus allowing some relative, longitudinal movement of the forward leg 38 of each plate 37 within each recess 39 without contact of the forward leg 38 with either end surface of the recess 39.

As may be appreciated from viewing FIG. 2B of the drawing, during a forward or leftward movement of the drive block 31, prior to engagement of the drive surface 32 of the drive block 31 with the rearward-facing, end surfaces 34,34 of the gripping members 12,12, the forward legs 38,38 of the two plates 37,37 may move freely forward in their their respective recesses 39,39. After engagement of the camming surfaces 33,33 with the follower surfaces 36,36 and then the drive surface 32 with the end surfaces 34,34, the forward legs 38,38 of the plates 37,37 and the gripping members 12,12 will be moved forward in unison with continued forward movement of the drive block 31. Upon a reversal of the movement of the drive block 31, the drive surface 32 and the camming surfaces 33,33, of the drive block 31 will initially be withdrawn from the end surfaces 34,34 and the follower surfaces 36,36 of the gripping members 12,12, respectively, while the forward legs 38,38 of the two plates 37,37 will move freely rearwardly in their respective recesses 39,39. As the camming surfaces 33,33 are disengaged from the follower surfaces 36,36, the rearward ends of the gripping members 12,12 will be free to open, i.e., to move slightly apart vertically, as will be explained more fully below. Then, upon the engagement of the forward legs 38,38 of the plates 37,37 with the rearward ends of the recesses 39,39 in the gripping members 12,12, the gripping members 12,12 be withdrawn rearwardly with continuing rearward movement of the drive block 31.

Figure 7:
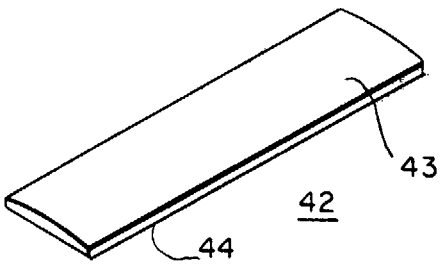
FIG. 7 is an enlarged, isometric view of one of a number of spring members which are included in the gripping member assembly shown in FIG. 4.

Referring now to FIG. 4 of the drawing, a mechanism which biases the two gripping members 12,12 apart vertically, toward a slight degree of vertical separation between the two chamber-forming elements 28,28 suitable for the feeding of an elongated workpiece between the chamber-forming elements 28,28, will next be described. This mechanism includes a number of thin, spring members 42,42, e.g., four spring members 42,42, which may be formed of any strong, resilient material, such as stainless steel. Each spring member 42 (FIG. 7) includes a pair of major surfaces 43 and 44 constituting opposed faces of the spring member 42, with one major surface 44 being substantially flat and the other major surface 43 being somewhat crested. Each gripping member 12 includes a pair of longitudinally-extending, arcuate-bottomed or arcuate-topped recesses 46,46 (FIG. 4), one located at each side of the semicircular channel 23 of the gripping member 12. As shown in FIG. 4, each recess 46 may extend into a radially outward portion of each semicircular channel 23 and of each set of sectors 22,22. A different one of the spring members 42,42 is so received in each of the recesses 46,46 in each gripping member 12 that the flat major surface 44 of the received spring member 42 bridges the arcuate bottom or top of its recess 46, facing, but not contacting, such bottom or top of the recess 46. As seen in FIG. 4 of the drawing, the arrangement is such that the crested surfaces 43,43 of two pairs of spring members 42,42 contact one another, with one spring member 42 of each such contacting pair residing in a recess 46 in the upper gripping member 12 and the other spring member 42 of the contacting pair residing in an associated recess 46 in the lower gripping member 12. The contact occurring along the crests of the surfaces 43,43 biases the two gripping members 12,12 slightly apart vertically, along the length of each gripping member 12, so that an elongated workpiece may readily be inserted between the chamber-forming elements 28,28 of the gripping members 12,12 in the retracted position of the gripping members 12,12. An exertion of sufficient pressure on the gripping members 12,12 in a vertically inward direction, i.e., toward the longitudinal axis 27 of the apparatus 10, will cause the spring members 42,42 to flex within the arcuate-bottomed or arcuate-topped recesses 46,46, allowing the two, one hundred eighty degree, chamber-forming elements 28,28 to be brought into tight engagement with one another about such an inserted, elongated workpiece, e.g., upon an activation of the piston and cylinder assemblies 29,29 (FIG. 2B) to move the drive block 31 forward.

Figure 5:
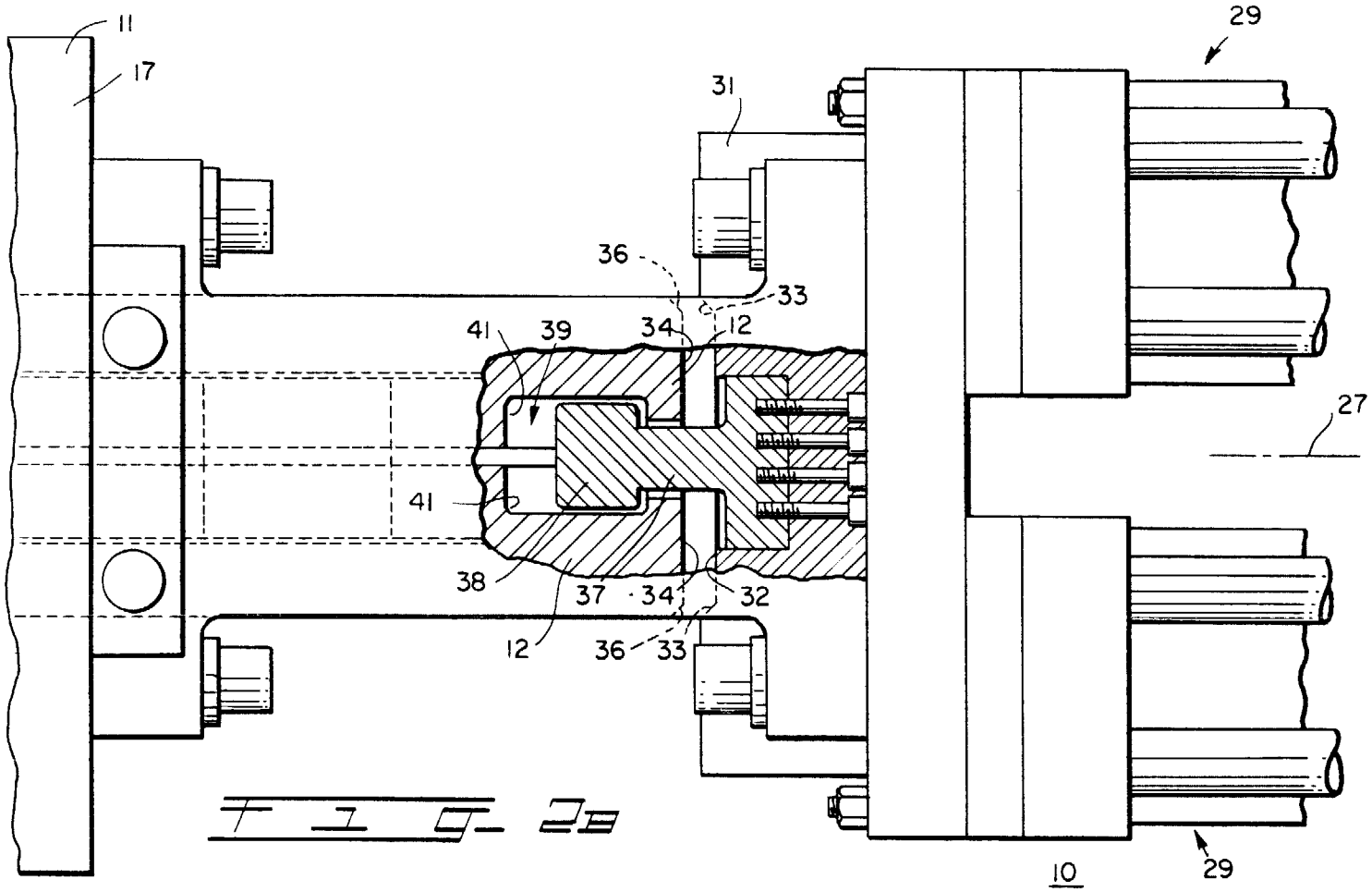
FIG. 5 is a plan view of a pressure block employed as part of the frame structure in the first embodiment of extrusion apparatus to support a gradient in hydrostatic pressure which increases in the direction of the extrusion station, i.e., toward the left as viewed in FIGS. 1B, 2A, 3 and 5, FIG. 5 also providing a schematic illustration of a hydraulic system employed with the first embodiment of extrusion apparatus.

A fluid-operated system works in conjunction with the camming surfaces 33,33 and the follower surfaces 36,36, and serves as a primary agency in bringing the chamber-forming elements 28,28 tightly together against the separating bias of the spring members 42,42 (FIG. 4). This same fluid-operated system also serves to apply a radial pressure to the exteriors of the chamber-forming elements 28,28, which radial pressure increases with displacement of the gripping members 12,12 toward the extrusion station 13, so as to support correspondingly increasing pressure levels present within an elongated workpiece located between the chamber-forming elements 28,28. Referring to FIG. 5 of the drawing, a pair of concentric, pressure-containing zones 47A and 47B is provided along an inwardly-facing, horizontal surface 48 of each pressure block 14, adjacent to an outwardly-facing, horizontal surface 49 (FIGS. 3, 4 and 13) of each gripping member 12. The concentric, pressure-containing zones 47A and 47B (FIG. 5) are defined, along an outer periphery of the inner zone 47A, and along inner and outer peripheries of the outer zone 47B, by a pair of concentric seals 51A and 51B. The inner seal 51A and the outer seal 51B are received in respective matching grooves in the inwardly-facing, horizontal surface 48 of their pressure block 14.

A suitable source of pressurized fluid, e.g., a pump P which communicates with a reservoir R containing a hydraulic fluid, is conncted to feed a pair of fluid lines 52A and 52B in each pressure block 14, which fluid lines open into the grooves beneath the seals 51A and 51B, respectively. The pressurized fluid serves to float the seals 51A and 51B within their grooves and thereby maintain contact of the seals 51A and 51B with the horizontal surface 49 of the adjacent gripping member 12 throughout the range of the previously mentioned, slight vertical movements of the gripping member 12. A valve V in fluid line 52B is effective to by-pass some of the fluid back to the reservoir R such that the pressure in fluid line 52B will be lower than that in fluid line 52A.

Two short fluid lines 52C and 52D are used to supply pressurized fluid to the concentric zones 47A and 47B, respectively. Fluid line 52C transmits fluid at relatively high pressure from the groove beneath the inner seal 51A to the inner, pressure-containing zone 47A, while fluid line 52D transmits fluid at reduced pressure from the groove beneath the outer seal 51B to the outer, pressure-containing zone 47B.

The highly pressurized fluid within the inner, pressure-containing zone 47A serves to accomplish the two, previously mentioned functions of the fluid-operated system. The fluid pressure forces each gripping member 12 vertically toward the other gripping member 12, serving, in cooperation with the previously described action of the camming surfaces 33,33 (FIGS. 2A and 2B), to clamp together the two chamber-forming elements 28,28 (FIG. 3) in tight engagement with one another about an elongated workpiece. The fluid pressure also supports the previously described, increasing pressure level within the elongated workpiece, and within a wax coating which preferably covers the outer periphery of the workpiece as will be discussed below, as the elongated workpiece is advanced toward and then through a die at the extrusion station 13. Accordingly, the seal 51A is so shaped, as seen in FIG. 5, as to define an inner, pressure-containing zone 47A which increases in width, and, thus, in pressure supporting capability, toward the extrusion station 13, such that the axially increasing pressure profile within the advancing elongated workpiece and its coating is substantially matched.

Due to the use of the by-pass valve V in fluid line 52B, the outer, pressure-containing zone 47B, located between the seals 51A and 51B, supports a lower level of pressure than is present within the inner, pressure-containing zone 47A, thereby enhancing the life of the inner seal 51A by reducing the pressure drop across such seal 51A. The outer seal 51B which bounds the outer, pressure-containing zone 47B advantageously has a shape which is substantially similar to that of the inner seal 51A.

A central channel 54 is preferably located within the inwardly-facing, horizontal surface 48 of the pressure block 14 along the inner, pressure-containing zone 47A, the channel 54 serving to assist passage of fluid from the inner zone 47A into an exhaust line 56 during depressurization of the inner zone 47A. A check valve CV is suitably located within the exhaust line 56, which may feed back to the reservoir R through or past the pump P. The arrangement is such that the check valve CV will close off the exhaust line 56 during application of pressure to the inner zone 47A through fluid lines 52A and 52C, but will permit discharge of fluid through the exhaust line 56 upon depressurization of fluid line 52A. A similar fluid-exhausting arrangement (not shown) may be employed with the outer, pressure-containing zone 47B. At the locations where the fluid lines 52A and 52B open into the grooves beneath the respective seals 51A and 51B, a pair of valves (not shown) may be employed to prevent extrusion of the seals 51A and 51B into the fluid lines 52A and 52B upon release of pressurized fluid from the concentric zones 47A and 47B. Such valves allow pressurized fluid to flow through the fluid lines 52A and 52B in an inward direction only, i.e., into the grooves beneath the respective seals 51A and 51B.

Figure 8:
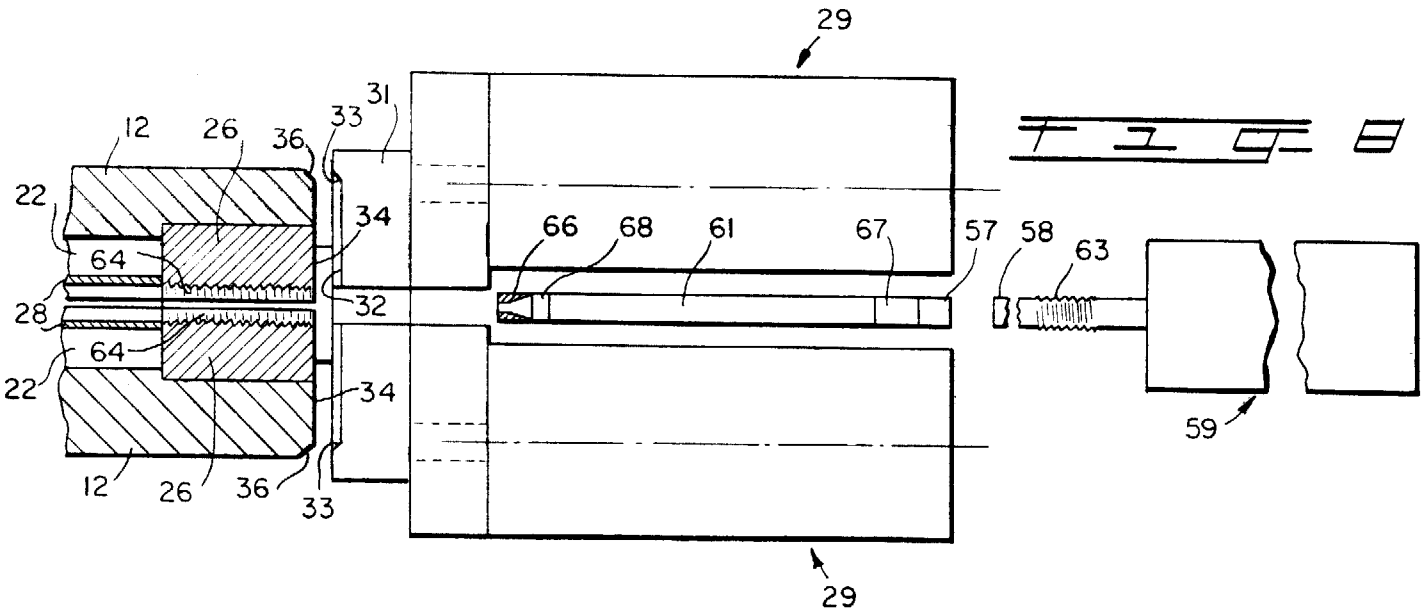
FIG. 8 is a schematic illustration of mechanisms which may be employed to feed automatically a succession of billets, dies and dummy billets between the gripping members of the apparatus.
Figure 9:
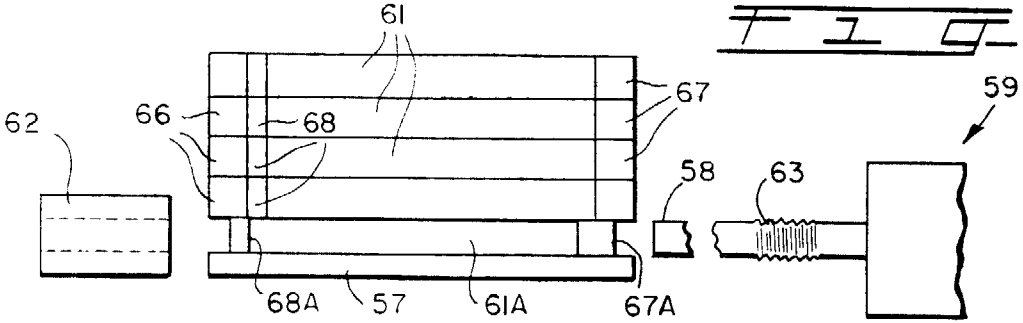
FIG. 9 is a schematic illustration of a magazine for housing a number of billets, dies and dummy billets, which magazine functions in cooperation with the automatic feeding mechanisms illustrated in FIG. 8.

A mechanism suitable for loading a succession of discrete, elongated workpieces of finite length, i.e., billets, between the gripping members 12,12 in their retracted position, is illustrated schematically in FIGS. 8 and 9 of the drawing. Such mechanism includes a magazine 57, a feed ram 58 and a feed cylinder 59. The feed cylinder 59 is operable under fluid pressure to reciprocate the ram 58 forwardly and rearwardly, i.e., leftwardly and rightwardly as viewed in FIGS. 8 and 9. The magazine 57 is capable of housing a number of billets 61,61, as well as other, associated elements which will be described below. Should it be desired that the billets 61,61 be extruded at elevated temperatures, the magazine 57 and/or the billets 61,61 may be heated by any conventional heating mechanism, as may also, if desired, various other components of the apparatus 10, e.g., the ram 58 and the gripping members 12,12. The apparatus 10 is, however, designed for very rapid loading and extrusion of the billets 61,61, such that heating of the ram 58 and the gripping members 12,12 will ordinarily not be necessary in hot extrusion operations.

The billets 61,61 in the magazine 57 may each be covered with a coating of a suitable hydrostatic medium, e.g., a beeswax or a polyethylene wax, as set forth in U.S. Pat. Nos. 3,740,985 and 3,985,011, both issued to F. J. Fuchs, Jr., the former of which has been reissued as U.S. Pat. No. Re. 28,795. Alternatively, the billets 61,61 may be extruded in an uncoated condition, or may be coated with a hydrostatic medium in an optional coating chamber 62 (FIG. 9), which coating chamber 62 may be located between the magazine 57 and the gripping members 12,12, as each billet 61 is fed to the gripping members 12,12. The coating chamber 62 may be of either of the types described in the previously mentioned patents to F. J. Fuchs, Jr.

It should be evident that a succession of operations of the feed cylinder 59 will cause a succession of reciprocating movements of the ram 58, with each forward or leftward movement of the ram 58, as viewed in FIGS. 8 and 9, delivering a new billet 61 into position between the gripping members 12,12. A simple gravity feed arrangement is suitable to position a new billet 61, while still located within the magazine 57, in line with the ram 58 prior to each such forward movement of the ram 58. As may best be seen in FIGS. 3 and 8, the feed ram 58 and the rearward portions of the gripping members 12,12 i.e., the rearward end members 26,26 of the gripping members 12,12, include mating, serrated portions 63 and 64,64, respectively. Thus, as will be explained more fully below, the gripping members 12,12 may grasp the ram 58 as the serrated portions 63 and 64,64 are brought into engagement, such that the ram 58 and the gripping members 12,12 may advance together in unison during each forward movement of the gripping members 12,12 toward and past the extrusion station 13.

One or more dies 66,66 may also be housed within the magazine 57. Each such die 66 is associated with a different one of the billets 61,61, although some (e.g., a lowermost billet 61A shown in FIG. 9) or even all of the billets 61,61 in the magazine may not have associated dies 66,66. Each successive die 66 is adapted to be fed automatically between the gripping members 12,12 with its associated billet 61, the successive die 66 thereby serving to replace a preceding die 66 at the extrusion station 13 (FIG. 3), so that the associated billet 61, which is to follow the replacing die 66 into the extrusion station 13, may thereupon be extruded through an aperture in the replacing die 66. The configuration of the aperture in the replacing die 66 may be either substantially identical to that of the replaced die 66, where a succession of like elongated products is desired and the die replacement is intended simply to compensate for die wear, or different from that of the replaced die 66, where a change in elongated products is desired. The outer surfaces of the dies 66,66 are preferably so configured as to be operatively engaged by the gripping members 12,12 during the movements of the gripping members 12,12 toward and into the extrusion station 13.

A number of dummy billets 67,67 may also be housed within the magazine 57. Each dummy billet 67 is located at a rearward or rightward end, as viewed in FIGS. 8 and 9, of a different, associated one of the billets 61, and is advantageously composed of a softer material, e.g., lead, then the material, e.g., copper or aluminum, of the associated billet 61. The dummy billets 67,67 preferably have outer surfaces which are so configured as to be operatively engaged by the gripping members 12,12 during their movements toward and into the extrusion station 13. Each dummy billet 67 aids in assuring that all of the material of the associated billet 61 is extruded through the aperture of a die 66 at the extrusion station 13, since each movement of the gripping members 12,12 toward and past the extrusion station 13 is to occur through a distance sufficient to extrude a portion of the trailing, associated dummy billet 67 with the billet 61. Such trailing dummy billet 67 will, of course, continue to be operatively engaged by the gripping members 12,12 as extrusion of the billet 61 through the aperture of the die 66 is completed. Thus, the advancing dummy billet 67 will continue to seal a moving, closed chamber, defined by the cooperating, chamber-forming elements 28,28, while also providing advancing forces to a rearward end of the billet 61 as it is extruded. In addition, should a new die 66 not be associated with the next billet 61 to be fed from the magazine 57, the remaining, unextruded portion of the dummy billet 67 will serve as a soft, starting nose upon the extrusion of such next billet 61 through a die 66 previously delivered to the extrusion station 13.

A number of additional dummy billets 68,68 may also be housed within the magazine 57. Each additional dummy billet is located between a die 66 and a billet 61, and is formed of a softer material, e.g., lead, than the material, e.g., copper or aluminum, of the associated billet 61. The additional dummy billets 68,68 will serve as soft, starting noses upon the extrusion of each new billet 61 through a new die 66 which is employed is conjunction with the new billet 61.

A longitudinally-extending, die stem 69, which is adapted to receive a succession of dies 66,66 at the extrusion station 13, is illustrated in FIGS. 1A and 3 of the drawing. A central aperture 71 (FIG. 3) passes axially through the length of the die stem 69 and serves as a passageway through which an extruded product, forced through an aperture in a die 66 at the extrusion station 13, may exit from the apparatus 10. A forward end 72 of the die stem 69, i.e., a leftward end in FIG. 1A, is supported in a mounting head 73. The mounting head 73 is movable along the axis 27 of the apparatus 10, driven by a pair of conventional, hydraulic piston and cylinder assemblies 74,74, between a forwardmost, die-changing position of the die stem 69, shown in FIG. 1A, and a rearwardmost, extrusion position of the die stem 69, in which extrusion position the die stem 69 is displaced toward the right from its FIG. 1A, die-changing position. A forward end of the mounting head 73, i.e., a leftward end in FIG. 1A, includes an opening (not shown) through which the extruded product may pass after leaving the die stem 69.

A collapsible, die stem supporting assembly 76 is adapted to support the die stem 69, while allowing movements of the die stem 69 between its die-changing and extrusion positions. The collapsible, die stem supporting assembly 76, which is generally similar to the collapsible feed mechanism disclosed in U.S. Pat. No. 3,548,625 to F. J. Fuchs, Jr., includes a number of centrally-apertured, alignment plates 77,77 and a centrally-apertured, end plate 78. The alignment plates 77,77 are slidable forwardly and rearwardly along the exterior of the die stem 69 and along inward surfaces 79,79 of a pair of side members 81,81. The end plate 78 is fixed to a pair of stationary posts 82,82. Each alignment plate 77 includes a number of forwardly extending bolts 83,83, with each bolt 83 having a head 84 located at a forward end of the bolt 83. The plates 77,77, . . . 78 are maintained at a maximum spacing, in the die-changing position of the die stem 69 illustrated in FIG. 1A, with each bolt head 84 captured in a recess 86 in the plate 77 or 78 which is located to the immediate left, as seen in FIG. 1A, of the plate 77 which carries the respective bolt 83. Sets of clearance apertures 87,87 are appropriately positioned in each plate 77 or 78, located forward or leftward of each bolt head 84, as shown in FIG. 1A. The sets of clearance apertures 87,87 extend for a sufficient distance to allow the entire set of plates 77,77 to be collapsed successively, upon a forward movement of the plates 77,77 into a position in which each plate 77 engages each adjacent plate 77 or 78. Such collapsed configuration of the plates 77,77, . . . 78 will occur, with the die stem 69 in its rearwardmost, extrusion position, as the forwardmost ends of the forwardly moving gripping members 12,12 engage the rearwardmost plate 77 and drive it, and the other plates 77,77 with it, forward. The collapsed plate configuration serves to provide maximum radial support to the die stem 69 so as to prevent any buckling during extrusion. Upon rearward movement of the gripping members 12,12, the plates 77,77 will be returned to the FIG. 1A die-changing position of the die stem supporting assembly 76 due to the force applied to each plate 77 by each associated bolt head 84, including the heads on a set of bolts (not shown) which extend forward from the gripping members 12,12 into a set of associated, vertically-extending slots in the rearwardmost plate 77.

At such time as each successive die 66 is to be replaced, the feed ram 58 (FIGS. 8 and 9) may be employed, in cooperation with the piston and cylinder assemblies 74,74, in a die-ejecting operation, to be described below. Alternatively, a separate ejection mechanism, which is shown schematically in FIG. 10 of the drawing, may be employed. Such ejection mechanism includes an ejection ram 88 which is movable vertically along a forward or leftward surface 89 of the rearwardmost or rightwardmost alignment plate 77 (see also FIG. 1A), driven by a conventional, fluid-operated, piston and cylinder assembly 91. With the collapsible, die stem supporting assembly 76 in its die-changing position, as depicted in FIG. 1A, the piston and cylinder assembly 91 may be operated to move the ejection ram 88 downwardly, causing the die 66 to be stripped from the die stem 69.

As best seen in FIG. 3, the length of the stroke S of apparatus 10 is also the combined length of billet 61 and the leading and trailing dummy billets 68 and 67, respectively. Because the length of the pressure blocks 14 is selected to be $2\times S$, the length of feed ram 58 extending to the left of serrated portions 63 will also be $2\times S$. Thus, as the feed ram is inserted between the gripping members 12 it will push billet 61 and leading and trailing dummy billets 68 and 67, respectively, to the left-hand half of pressure blocks 14 so that, when the hydraulic piston and cylinder assemblies 29—29 are actuated, dummy billet 68, billet 61, and at least a portion of the trailing dummy billet 67 will be extruded in a single stroke.

Referring now to FIGS. 11–14 of the drawing, certain aspects of stress conditions in the apparatus 10 will next be considered. Each of the sectors 22,22 which serves as an insert with respect to one of the gripping members 12,12 is an elongated element, extending around ninety degrees of the periphery of one of the two chamber-forming elements 28,28 (not shown in FIGS. 11–14 in order to clarify the illustration). The bore formed by the contacting, arcuate, radially-innermost surfaces 30,30 of the four sets of ninety degree sectors 22,22 (FIG. 13), which bore completely surrounds the two chamber-forming elements 28,28, will be subjected to a high compressive stress condition due to internal pressures occurring during extrusion, such stress condition tending to crush each sector 22 in a radial direction. To compensate for this high, radial, compressive stress condition, compressive stresses are applied to the sector 22 in the circumferential and axial directions also, in a manner now to be described.

A circumferential, compressive stress is applied to each sector 22 by the containment force of the gripping member 12, into which the sector 22 has been inserted, against the outer periphery of the sector 22 due to the press-fitting of the sector 22 into the associated, semicircular channel 23 in the gripping member 12. This force is made sufficiently high, by an appropriate selection of the dimensions of the sector 22 and the semicircular channel 23, to overcome the expected bore pressure while also prestressing the land areas 25,25 on the sector 22. Such prestressing is similar to the technique of auto frettage of thick-walled vessels.

An axial, compressive stress at the bore is achieved by initially forming each sector 22 with a normally curved shape, as shown in FIG. 12, curving outwardly along the arcuate, radially-innermost surface 30 of the sector 22. The curvature, which is exaggerated in FIG. 12 in order to clarify the illustration, is so selected that, upon press-fitting each sector 22 into its respective portion of an associated semicircular channel 23 in an associated gripping member 12, the sector 22 thereby being forced into a straightened condition, a compressive stress of a desired magnitude will be present at the bore formed by the contacting, arcuate, radially-innermost surfaces 30,30 of the various sectors 22,22. The bending of each of the sectors 22,22 into such straightened condition, as is known in beam theory, will impose a high compressive stress along the bore and a low tensile stress along the outermost surfaces of the sectors 22,22, a situation which is ideal for the extruder application.

The foregoing discussion with respect to compensation for radial, compressive stresses in the sectors 22,22 is also applicable to the two, one hundred eighty degree, chamber-forming elements 28,28. Similar selections of initial radius of curvature and dimensions may be made for the chamber-forming elements 28,28 prior to their being press-fitted into the bore formed by the arcuate, radially-innermost surfaces 30,30 of the cooperating sectors 22,22.

A stress system which operates on the gripping elements 22,22 will now be discussed with reference to FIG. 13 of the drawing. During extrusion, radially-outwardly directed pressures from within the sectors 22,22 will be balanced by fluid pressures along the outwardly-facing, horizontal surfaces 49,49 of the gripping members 12,12. The load transmitted by the sectors 22,22 to the gripping members 12,12 will tend to create both a moment about a neutral axis position A and a lateral tensile stress within each gripping member 12. The load on the gripping member 12 caused by the fluid pressure along its outwardly-facing, horizontal surface 49 will meanwhile create a vertical, compressive stress within the gripping member 12. These effects are additive, tending to rupture the gripping member 12 at the surface radially inwardly of the neutral axis position A. Accordingly, it is advantageous to develop a lateral compressive stress in each gripping member 12 in order to eliminate the described lateral tensile stress and to counter the compressive load radially inwardly of the neutral axis position A.

Lateral compressive stresses may be developed in the gripping members 12,12 by providing support for the gripping members 12,12, against the vertical pressures along their outwardly-facing, horizontal surfaces 49,49, only at the raised land areas 25,25 of the sectors 22,22, and making the gripping members 12,12 and the pressure-containing zones 47A and 47B (FIG. 5) sufficiently wide that such vertical pressures along the outwardly-facing, horizontal surfaces 49,49 cause a suitable degree of bending of the gripping members 12,12 about the sectors 22,22. Thus, through an appropriate choice for the width of the pressure-containing zones 47A and 47B and the thickness of the gripping members 12,12, the bending of the gripping members 12,12 will set up a desired level of lateral compressive stress radially inwardly of the neutral axis position A. In this manner, stresses may be so balanced across each gripping member 12 that very high extrusion pressures may be achieved within the apparatus 10.

Figure 14:
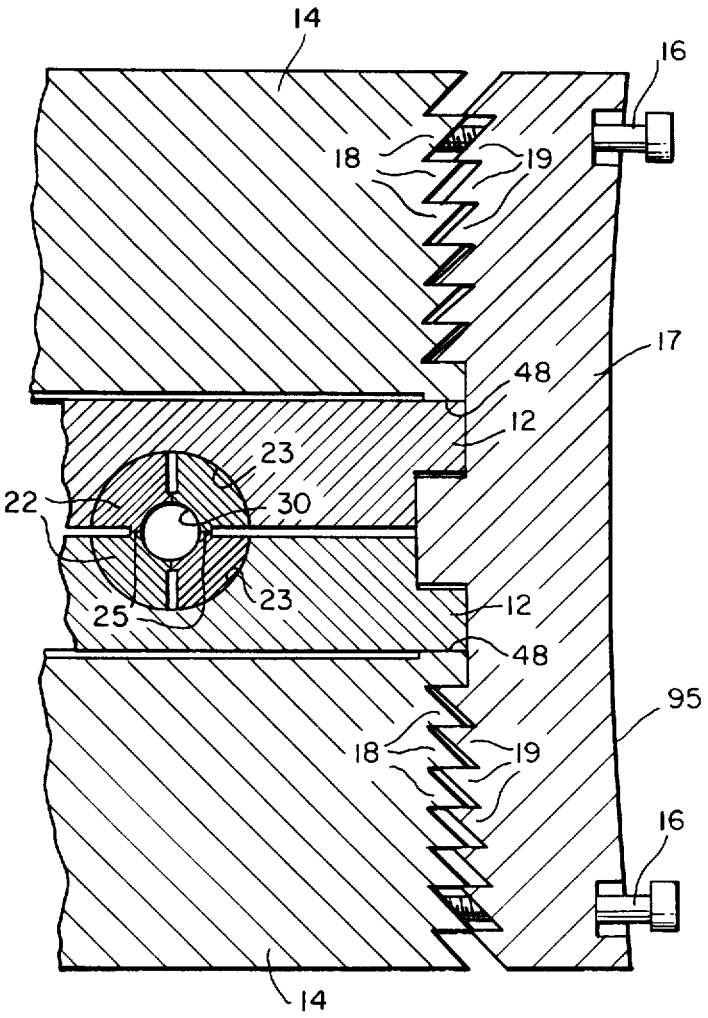

A stress system which operates on the side wall members 17,17 will now be discussed with reference to FIG. 14 of the drawing. The two pressure blocks 14,14 tend to be forced vertically apart by fluid pressures along their inwardly-facing, horizontal surfaces 48,48. The side wall members 17,17, due to the interaction between the interlocking serrations 18,18 and 19,19 on the pressure blocks 14,14 and the side wall members 17,17, respectively, serve to retain the pressure blocks 14,14 against the vertical, separating forces. Thus, the side wall members 17,17 will be subjected to elongating forces which will cause tensile stresses along the serrated surfaces. Because of the stress-concentrating effect of the serrations 19,19, the stress at the serrations 19,19 will be simplified to approximately three times the stress level present elsewhere in the side wall members 17,17.

A prebending technique is used to compensate for the tensile stresses in the side wall members 17,17 and the stress-concentrating effect of the serrations 19,19. As may be seen in FIG. 14, which shows one of the side wall members 17,17 prior to the tightening of the bolts 16,16, the side wall members 17,17 are tapered. In particular, the side wall members 17,17 are made wider along their vertical center portions, where the side wall members 17,17 engage the gripping members 12,12, than along the upper and lower portions of the side wall members 17,17, where they engage the pressure blocks 14,14. Thus, upon the tightening of the bolts 16,16 in the assembly of the apparatus 10, the side wall members 17,17 are so bent as to establish compressive stresses along their serrated surfaces. These compressive stresses are applied along the serrations so as to oppose loading-caused, tensile stresses, enabling the side wall members 17,17 to support twice the loading otherwise supportable by them.

For purposes of simplified analysis, a one inch by one inch thick side wall member 17 with an allowable stress level of 120,000 psi will now be considered. If the side wall member 17 were initially straight, rather than tapered, the allowable load would be 40,000 pounds, since the stress concentration factor of three-to-one would then cause a tensile stress of 120,000 psi to be present at the serrations 19,19. If the side wall member 17 is tapered, however, and is prebent, as described, to cause a concentrated stress of −120,000 psi (i.e, a 120,000 psi compressive stress) at the serrations 19,19, then a tensile stress along an outer surface 95 of the side wall member 17, caused by the prebending, would be at a level of 40,000 psi. Then, upon loading the side wall member with a force of 80,000 pounds, the tensile stress along the outer surface 95 would rise to 120,000 psi (40,000 psi+80,000 psi). Meanwhile, due to the stress-concentrating effect of the serrations 19,19, a first 40,000 pounds of the 80,000 pound load would cancel out the −120,000 psi prestress level (120,000 psi compressive stress) at the serrations 19,19. The remaining 40,000 pounds of the 80,000 pound load would build up a concentrated tensile stress level of 120,000 psi at the serrations 19,19. Accordingly, the 80,000 pound load may be adequately supported by the side wall member 17.

The operation of the apparatus 10, which constitutes a first embodiment of apparatus in accordance with the principles of the invention, will next be discussed. It will be assumed, for purposes of such discussion, that the magazine 57 (FIG. 9) is initially loaded with a number of unheated, unwaxed billets 61,61, which are each to acquire a coating of wax in passing through the coating chamber 62. Alternatively, of course, pre-waxed and/or heated billets 61,61 might be employed. In order to illustrate the operation of the apparatus 10 in a mode in which dies are not changed between extrusion operations on successive billets 61,61, a new die 66 is taken not to be located at a forward end of a lowermost billet 61A in the magazine 57, which lowermost billet 61A is first to be loaded between the gripping members 12,12 (FIG. 8) and the extrusion of which is, thus, first to be discussed. However, in order to illustrate the operation of the apparatus 10 in a mode in which dies 66,66 are changed between extrusion operations on successive billets 61,61, new dies 66,66 are taken to be located at a forward end of each billet 61 in the magazine 57 other than the lowermost billet 61A. A different pair of dummy billets 67 and 68 is assumed to be associated with each of the billets 61,61 in the magazine 57, including a pair of lowermost dummy billets 67A and 68A associated with the lowermost billet 61A. Each forward dummy billet 68 or 68A is located immediately forward of its associated billet 61 or 61A; each new die 66, which is used with a billet 61 other than the lowermost billet 61A, is located immediately forward of the associated, forward dummy billet 68; and each rearward dummy billet 67 or 67A is located immediately rearward of its associated billet 61 or 61A.

The feed ram 58, the drive block 31 and the gripping members 12,12 are taken initially to be in a rearwardmost, rightwardmost, retracted position of each, while the die stem 69 (FIG. 1A) is in its rearwardmost, rightwardmost, extrusion position. Pressurized fluid is taken initially to be absent from the concentric, pressure-containing zones 47A and 47B (FIG. 5) along the inwardly-facing horizontal surface 48 of each pressure blocks 14, such that the spring members 42,42 (FIG. 4), which bias the gripping members 12,12 apart, maintain a slight vertical separation between the two, one hundred eighty degree, chamber-forming elements 28,28.

Pressurized fluid is now supplied, in conventional manner, to the feed cylinder 59 (FIGS. 8 and 9). The feed ram 58 is moved forward, i.e., leftward in FIGS. 8 and 9, driving the lowermost billet 61A in the magazine 57, and with it its associated dummy billets 67A and 68A, into the space between the two, presently-separated, chamber-forming elements 28,28 of the gripping members 12,12. During the advance of the billet 61A into the space between the two chamber-forming elements 28,28, the billet 61A is provided, while passing through the coating chamber 62, with a surface coating of a wax or other hydrostatic medium. The forward movement of the feed ram 58 is then interrupted momentarily as the serrated portion 63 of the feed ram 58 reaches a position of vertical alignment with the serrated portions 64,64 on the rearward end members 26,26 of the gripping members 12,12. At this same time, the leading dummy billet 68A at the forward end of the billet 61A preferably engages an entrance portion of a die 66 (FIG. 3) presently located at the extrusion station 13 at a rearward end of the die stem 69.

The concentric, pressure-containing zones 47A and 47B (FIG. 5), located along the inwardly-facing, horizontal surface 48 of each pressure block 14, are next supplied with pressurized fluid from the pump P. Pressure within the concentric zones 47A and 47B, acting upon that portion of the outwardly-facing, horizonal surface 49 (FIG. 3) of each gripping member 12 which is located opposite the inwardly-facing, horizontal surface 48 of the adjacent pressure block 14 causes the gripping members 12,12 to be driven together against the separating bias of the spring members 42,42 (FIG. 4), thereby clamping the two chamber-forming elements 28,28 tightly together to form a closed, sleeve-like, pressure chamber about the waxed billet 61A.

At approximately the same time as the pressurized fluid is introduced into the concentric zones 47A and 47B to drive the gripping members 12,12 vertically toward one another, piston and cylinder assemblies 29,29 (FIGS. 2B and 8) are operated. The drive block 31 is driven forward, i.e., leftward in FIGS. 2B and 8, causing the camming surfaces 33,33 on the drive block 31 to engage the follower surfaces 36,36 on the rearward-facing, end surfaces 34,34 of the gripping members 12,12. The engagement between the camming surfaces 33,33 and the follower surfaces 36,36 forces the gripping members 12,12 vertically together, along their rearward-facing, end surfaces 34,34, rearwardly of the pressure blocks 14,14 (FIG. 3), and thereby assists the previously described, fluid-operated system in clamping the gripping members 12,12 and their chamber-forming elements 28,28 tightly together along the entire lengths of the respective members 12,12 and elements 28,28. As the chamber-forming elements 28,28 close about the waxed billet 61A, the serrated portion 63 (FIG. 8) of the feed ram 58 is grasped tightly by the serrated portions 64,64 of the gripping members 12,12. The closed chamber formed about the waxed billet 61A by the engaged, chamber-forming elements 28,28 is how effectively sealed at its rearward end by the trailing dummy billet 67A and a forward portion of the feed ram 58.

As the drive block 31 continues to move forward, driven by piston and cylinder assemblies 29,29, the drive surface 32 of the drive block 31 comes into firm engagement with the rearward-facing, end surfaces 34,34 of the gripping members 12,12, and begins to advance the gripping members 12,12, the waxed billet 61A, and the leading and trailing dummy billets 68A and 67A, respectively, toward and past the extrusion station 13. The advance of the waxed billet 61A occurs through an application of viscous drag forces within the wax coating which completely covers the exterior of the billet 61A. The leading dummy billet 68A provides a soft, starting nose which facilitates the initiation of an extrusion operation on the waxed billet 61A as the billet 61A is advanced into and through an aperture in the die 66 (FIG. 3) currently located at the extrusion station 13 in contact with the rearward end of the die stem 69. As the gripping members 12,12 advance, a major portion of the closed chamber defined by the engaged, chamber-forming elements 28,28 advances past the die 66, causing the entire length of the waxed billet 61A, as well as a portion of the trailing billet 67A, to be extruded through the aperture of the die 66, and thereby deforming the billet 61A into an elongated product. The elongated product exits from the apparatus 10 through the central aperture 71 of the die stem 69.

During the advance of the waxed billet 61A toward and into the die 66, the internal pressure levels in the billet 61A and its wax coating increase substantially within the advancing, closed pressure chamber defined by the engaged, chamber-defining elements 28,28. Thus, a pressure gradient, increasing in the forward direction toward the die 66, is developed in the pressure chamber. The gradient is of sufficient magnitude to render the material of the waxed billet 61A significantly more ductile and, thus, more readily extrudable, as it enters the aperture of the die 66. The lateral profiles of the concentric, pressure-supporting zones 47A and 47B (FIG. 5) correspond substantially to this gradient in the internal pressure within the advancing, closed pressure chamber, as has already been indicated, such that a substantially balancing of forces is achieved across the chamber-forming elements 28,28 and the gripping members 12,12. The outward pressures on the inwardly-facing horizontal surfaces 48,48 of the pressure blocks 14,14 are supported by the previously described engagement between the horizontally extending, vertically outwardly facing surfaces 21,21 (FIGS. 4 and 6) of the serrations 18,18 on the pressure blocks 14,14 and the mating, horizonal extending, vertically inwardly facing surfaces of the serrations 19,19 on the sidewall members 17,17.

Once the entire billet 61A (FIG. 9) and a portion of the trailing dummy billet 67A have been extruded through the aperture of the die 66 (FIG. 3) at the extrusion station 13, forward movement of the drive block 31 and, thus, of the gripping members 12,12 ceases. Pressure may now be released from the concentric, pressure-containing zones 47A and 47B, and piston and cylinder assemblies 29,29 may be reversed. Thus, the drive block 31 is retracted rearwardly or rightwardly, as viewed in FIG. 2B of the drawing, with the forward leg 38 of each generally "H"-shaped plate 37 initially moving freely rearwardly within its recess 39 in the now-stationary, gripping members 12,12. As the camming surfaces 33,33 on the drive block 31 are withdrawn from the follower surfaces 36,36 on the rearward-facing, end surfaces 34,34 of the gripping members 12,12, and as the pressurized fluid is exhausted from the concentric zones 47A and 47B, the spring members 42,42 (FIG. 4) cause the gripping members 12,12 to separate slightly in a vertical direction. Thus, the gripping members 12,12 are disengaged from the die 66 and the remaining portion of the trailing dummy billet 67A, and the serrations 63 and 64,64 (FIG. 8) are separated. Then, as the forward legs 38,38 (FIG. 2B) of the generally "H"-shaped plates 37,37 contact the rearward ends of the recesses 39,39 in the gripping members 12,12, continued rearward movement of the drive block 31 back into its initial, retracted position withdraws the now slightly separated, gripping members 12,12 into their initial, retracted positions.

Since a new or second die 66 (FIG. 9) is associated with the next billet 61 to be extruded, requiring that a first die 66, i.e., the die 66 presently located in the extrusion station 13 be removed prior to the extrusion of such next billet 61, the feed ram 58 is not withdrawn into its initial, retracted position with the withdrawal of the drive block 31 and the gripping members 12,12. Were no second die 66 associated with the next billet 61, however, withdrawal of the feed ram 58 would occur with withdrawal of the drive block 31 and the gripping members 12,12. In such event, the remaining portion of the dummy billet 67 which has not been extruded through the aperture in the first die 66 would be available for use as a soft, starting nose for the extrusion of the next billet 61 through such aperture in the first die 66.

With the gripping members 12,12 now disengaged from the first die 66 and the remaining portion of the dummy billet 67A, the feed cylinder 59 drives the feed ram 58 further forward, toward the left in FIG. 8. At this same time, piston and cylinder assemblies 74,74 are operated to move the die stem 69 forward, toward the left in FIG. 1A. As the die stem 69 enters its die-changing position, shown in FIG. 1A, the feed ram 58 pushes the first die 66 and the remainder of the dummy billet 67A through the central aperture in the rearwardmost alignment plate 77, allowing the first die 66 and the remainder of the dummy billet 67A to fall freely into a suitable receptacle (not shown). Alternatively, the ejection ram 88 (FIG. 10) may be actuated to strip the first die 66 and the remainder of the dummy billet 67A from the end of the die stem 69. If the ejection ram 88 is employed, it may not be necessary to use the feed ram 58 to push the first die 66 and the remainder of the dummy billet 67A forward from the extrusion station 13 as the die stem 69 is moved into its die-changing position. At the end of the die changing operation, whichever alterative way it may be performed, the die stem 69 is returned to its initial, extrusion position, and the feed ram 58, if currently extended, is returned to its initial, retracted position.

The next billet 61 (FIG. 9) now drops to the bottom of the magazine 57, in line with the feed ram 58, as do the second die 66, and new dummy billets 67 and 68. The new billet 61, the second die 66, and the new dummy billets 67 and 68 may now immediately be advanced by the action of the feed ram 58 into the space between the chamber-forming elements 28,28 of the vetically separated, gripping elements 12,12. The advance of the feed ram 58 terminates as the second die 66 is brought into engagement with the rearward end of the die stem 69 (FIG. 3) at the extrusion station 13. A second vertical closing and reciprocating operation of the gripping members 12,12 may now be employed to extrude the new billet 61 through an aperture in the second die 66, similarly to the previously described extrusion of the preceding billet 61 through the aperture of the first die 66, whereupon the various components of the apparatus 10 may again be returned to their initial positions. Additional, similar, extrusion operations may thereafter be performed, in like manner and in rapid succession, by the apparatus 10.

Figure 15:
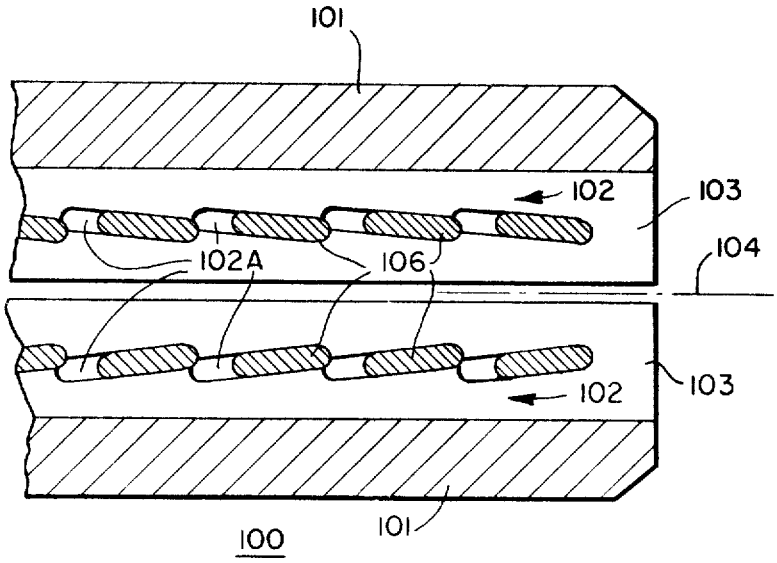
FIG. 15 is a side elevation view, partly in section, of rear portions of two modified gripping members which, together with modified drive mechanisms, portions of which are also shown, in section, in FIG. 15, make up a second embodiment of extrusion apparatus constructed in accordance with the principles of the invention.
Figure 16:
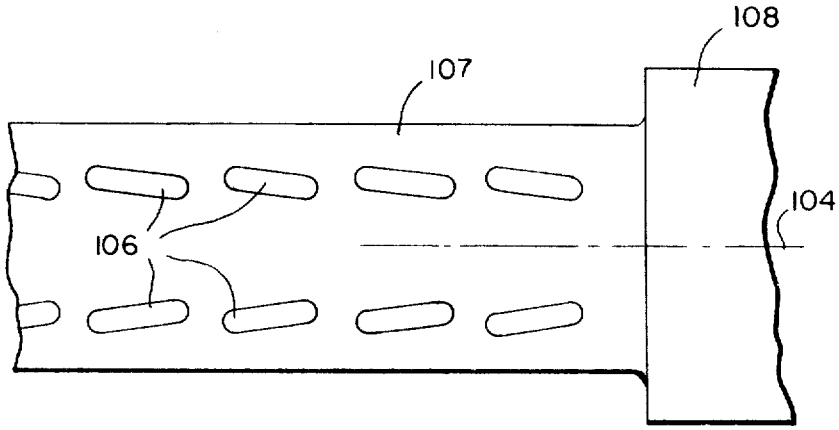
FIG. 16 is a side elevational view of one of two driving and camming bars which provide the modified drive mechanisms of the second embodiment of extrusion apparatus.

Turning now to FIGS. 15 and 16 of the drawing, portions of an alternative apparatus 100, which constitutes a second embodiment of apparatus in accordance with the invention, are illustrated. Except for the portions of the apparatus 100 shown in FIGS. 15 and 16, the apparatus 100 may be substantially identical to the apparatus 10 which has already been described. Accordingly, only the differences between the apparatus 100 and the apparatus 10 will be discussed below.

The apparatus 100 departs from the apparatus 10 in the nature of the mechanisms for closing and opening, and for driving, a pair of gripping members 101,101 (FIG. 15) whch correspond to the gripping members 12,12 of the apparatus 10. Each gripping member 101 includes a compound slot 102 along each outer sidewall 103 of the gripping member 101. Each compound slot 102 is composed of a set of preferably, but not necessarily, interconnected slot portions 102A,102A. Each slot portion 102A extends at a slight vertical angle to a centerline 104 of the apparatus 100, such that a forward or leftward end of each slot portion 102A, as viewed in FIG. 15, is spaced vertically from the centerline 104 by a distance somewhat greater than the spacing of a rearward or rightward end of the slot portion 102A from the centerline 104. The slot portions 102A,102A of each compound slot 102 in each gripping member 101 provide cam-following surfaces which are adapted to interact with a number of cams 106,106 on a one or the other of two driving and camming bars 107,107, one of which is shown in FIG. 16. Such interaction functions, in a manner which will be described below, both to move the gripping members 101,101 vertically together and apart, and to cause axial reciprocations of the gripping members 101,101.

Each of the cams 106,106 projects laterally inwardly from its driving and camming bar 107, and extends into a different one of the slot portions 102A,102A of the compound slots 102,102 in the gripping members 101,101. Each cam 106 has a similar shape to, but is of a lesser length than, the slot portion 102A which receives the cam 106. More particularly, a forward or leftward end of each cam 106, as viewed in FIGS. 15 and 16, is spaced vertically from the centerline 104 of the apparatus 100 by a distance somewhat greater than the spacing of a rearward or rightward end of the cam 106 from the centerline 104. A drive block 108, which carries the two driving and camming bars 107,107 and which corresponds to the drive block 31 of the apparatus 10, is axially reciprocable upon the operation of one or more suitable piston and cylinder assemblies similar to piston and cylinder assemblies 29,29 of the apparatus 10.

The operation of the apparatus 100 is substantially similar to that of the apparatus 10. Accordingly, once again, only the differences in operation will be discussed. As the drive block 108 of the apparatus 100 is moved forward or leftward in FIG. 16, with the gripping members 101,101 initially in their rightwardmost, retracted positions, an initial leftward advance of the cams 106 along the sloping slot portions 102A,102A of the compound slots 102,102 forces the gripping members 101,101 into tight vertical engagement with one another so as to form a closed pressure chamber about a billet which is to be extruded through a die at an extrusion station. Continued forward movement of the drive block 108 then causes the cams 106,106 to drive the vertically-engaged, gripping members 101,101 forward, e.g., upon contact of a forward end of each cam 106 with a forward end of its respective slot portion 102A, so as to effect extrusion. After extrusion, a rearward or rightward movement of the drive block 108 first withdraws the cams 106,106 rightwardly along their slot portions 102A,102A, causing the gripping members 101,101 to separate slightly vertically. Further rearward movement of the cams 106,106 in the slot portions 102A,102A, e.g., as a rearward end of each cam 106 engages a rearward end of its respective slot portion 102A, then returns the gripping members 101,101 to their initial, retracted positions.

It is to be understood that the described methods and apparatus are simply illustrative of preferred embodiments of the invention. In other embodiments, successive reciprocations of the gripping members might serve to advance, and cause the extrusion of, successive longitudinal portions of a single workpiece of indefinite length. Many additional modifications may, of course, be made in accordance with the principles of the invention.

What is claimed is:

1. In combination with a method of extruding first and second elongated workpieces to form first and second elongated products, respectively, wherein a plurality of gripping members are operatively engaged with the first and second elongated workpieces simultaneously to form respective extrusion chambers thereabout, and wherein the gripping members are so displaced as to advance the operatively engaged, first and second elongated workpieces successively into and through an extrusion station, the additional steps of:

(a) locating between the plurality of gripping members, adjacent to that end of the second elongated workpiece which is closest to the extrusion station, a second die for replacing a first die, through an aperture of which first die the first elongated workpiece is extruded upon the advance of the first elongated workpiece into and through the extrusion station to form said first elongated product;

(b) causing the first die to be displaced from the extrusion station after the first elongated workpiece has been extruded therethrough;

(c) advancing the second die into the extrusion station, due to said displacement of the plurality of gripping members, ahead of the advance of the second elongated workpiece into the extrusion station; and then (d) retaining the second die in the extrusion station while the second elongated workpiece is advanced through the extrusion station so as to extrude the second elongated workpiece through an aperture in the second die to form said second elongated product.

2. A combined method as set forth in claim 1, wherein step (a) comprises:

(e) locating between the plurality of gripping members, adjacent to that end of the second elongated workpiece which is closest to the extrusion station, a second die with an aperture of a configuration substantially identical to the configuration of the aperture through the first die so that the configuration of the second elongated product will be substantially identical to the configuration of the first elongated product.

3. A combined method as set forth in claim 1, wherein step (a) comprises:

(e) locating between the plurality of gripping members, adjacent to that end of the second elongated workpiece which is closest to the extrusion station, a second die with an aperture of a configuration differing from the configuration of the aperture through the first die so that the configuration of the second elongated product will differ from the configuration of the first elongated product.

4. A combined method as set forth in claim 1, further comprising:

(e) locating a dummy billet between said second die and said closest end of the second elongated workpiece, which dummy billet is composed of a material softer than the material of the second elongated workpiece, such that the dummy billet may serve as a starting nose for the extrusion of the second elongated workpiece.

* * * * *